United States Patent [19]

Shoemaker et al.

[11] 4,179,157

[45] Dec. 18, 1979

[54] WALL RECLINING ROCKING CHAIR

[75] Inventors: Edwin J. Shoemaker; William Pacitti; Marvin J. Baumann, all of Monroe, Mich.

[73] Assignee: La-Z-Boy Chair Company, Monroe, Mich.

[21] Appl. No.: 903,806

[22] Filed: May 8, 1978

[51] Int. Cl.[2] ..... A47C 1/02

[52] U.S. Cl. ..... 297/83; 248/429; 297/DIG.7; 297/259

[58] Field of Search ..... 297/DIG. 7, 83, 270, 297/271, 259, 317, 269; 248/429, 393, 298; 308/3 R; 403/83

[56] References Cited

U.S. PATENT DOCUMENTS

| | | | |
|---|---|---|---|
| Re.28,210 | 10/1974 | Re | 297/83 |
| 871,263 | 11/1907 | Flindall . | |
| 1,766,840 | 6/1930 | Rose . | |
| 1,821,247 | 9/1931 | Thomas | 248/429 |
| 1,821,299 | 9/1931 | Ferreira . | |
| 2,102,979 | 12/1937 | Smith . | |
| 2,270,172 | 1/1942 | Rugger . | |
| 2,313,023 | 3/1943 | Rugger . | |
| 2,834,397 | 5/1958 | Kluglein . | |
| 3,096,121 | 7/1963 | Knabusch et al. | 297/DIG.7 |
| 3,445,143 | 5/1969 | Swenson | 308/3.6 X |
| 3,622,198 | 11/1971 | Ré | 297/DIG.7 |
| 3,638,995 | 2/1972 | Flanagan | 297/DIG.7 |
| 3,802,735 | 4/1974 | Ré | 297/DIG.7 |
| 3,856,346 | 12/1974 | Herman | 297/61 |
| 4,057,289 | 11/1977 | Jones | 297/259 |
| 4,057,289 | 11/1977 | Jones | 297/259 |

*Primary Examiner*—James T. McCall

*Attorney, Agent, or Firm*—Harness, Dickey & Pierce

[57] ABSTRACT

A reclinable chair is rockable on a sub-frame which is movable forwardly and rearwardly on a base. The chair and sub-frame are supported on the base on a pair of facing channels which slope downwardly from the rear to the front of the base. The sub-frame and base are locked together in the rear and forward positions, the lock at the rear being released when the activating handle for the legrest at the righthand side of the chair is raised 10 or 15°. The further movement of the handle extends the legrest forwardly of the seat. The weight of the occupant when seated in the chair assists in the movement of the chair to the forward position during which the downward movement of a Boden wire secured to the sprung surface of the seat or to a lever pivoted thereon releases the actuating element. The wire operates the element and unlatches the chair when in forward position as the occupant leaves the chair seat or operates the lever and permits a spring to return the chair to its rear latched position. A lever prevents the rocking of the chair until the chair reaches its forward position where it is stopped in its forward movement as it releases the chair for rocking. When in forward position, the back of the chair may be reclined and the legrest may be extended in which position a ratchet mechanism becomes effective to prevent the chair from rocking or tilting forwardly.

11 Claims, 9 Drawing Figures

WALL RECLINING ROCKING CHAIR

BACKGROUND OF THE INVENTION

The patent to Re'U.S. Pat. No. Re. 28,210 shows a chair which moves from a wall when the back is reclined toward the wall. U.S. Pat. No. 3,096,121 of the present assignee shows a legrest mechanism which when the legrest is in forward position locks the chair against rocking. U.S. Pat. No. 3,525,549, assigned to the present assignee, discloses a reclining chair in which the back is tiltable backwardly as the seat is moved forwardly and upwardly. The patent shows slides at the edges of the back frame which permit the upholstered back to be removed for compact shipment. The composite of these patents are incorporated in applicants' assignee's patent application U.S. Ser. No. 853,202, filed Nov. 21, 1977, and in the structure of the present disclosure.

BRIEF DESCRIPTION OF THE DRAWINGS

FIG. 3 is a view of the chair illustrated in FIG. 2 with parts removed and others substituted;

DESCRIPTION OF THE PREFERRED EMBODIMENT

Figure 1:
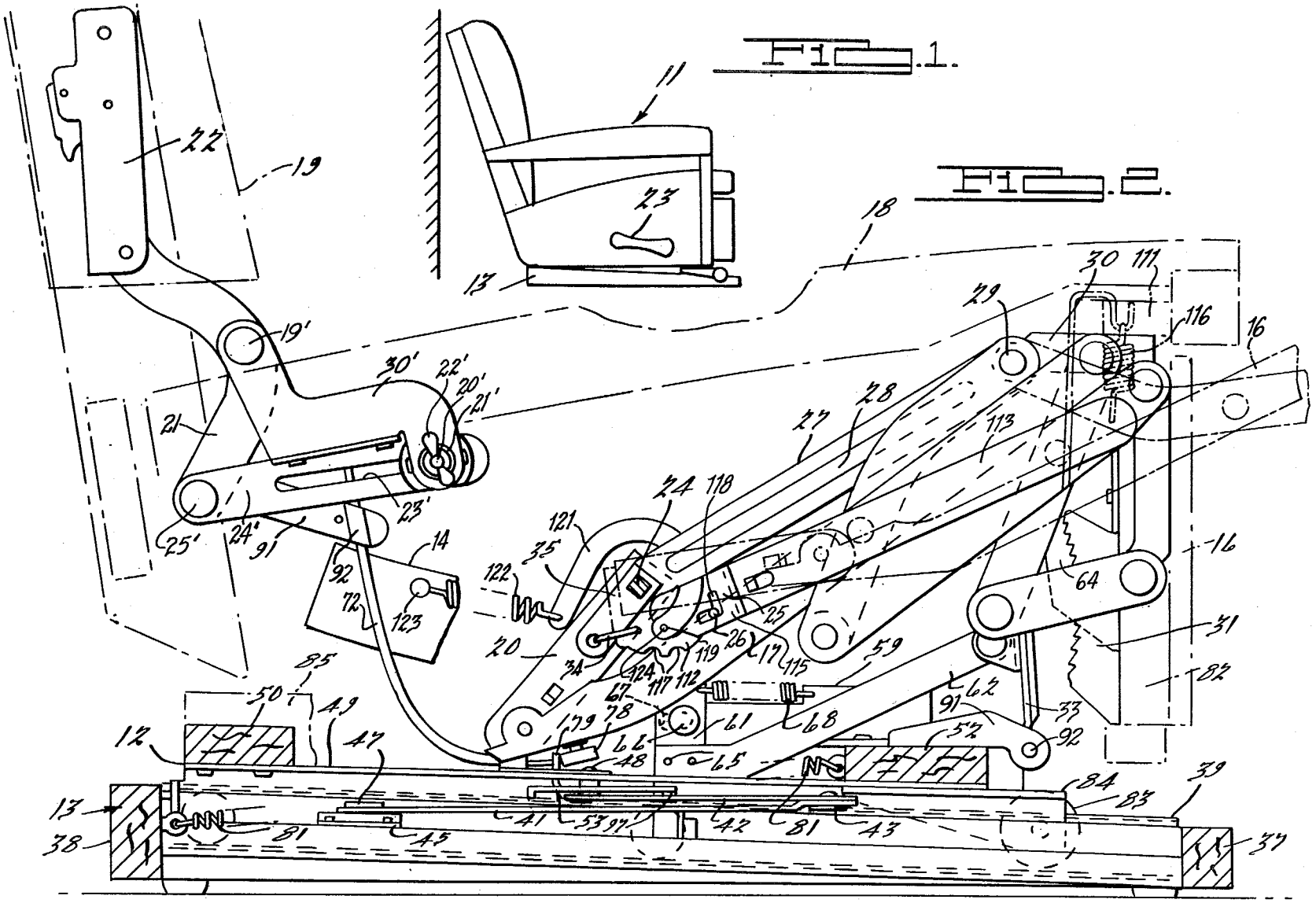
FIG. 1 is a view of a chair which is rockable when moved forwardly and which embodies features of the present invention.
Figure 2:
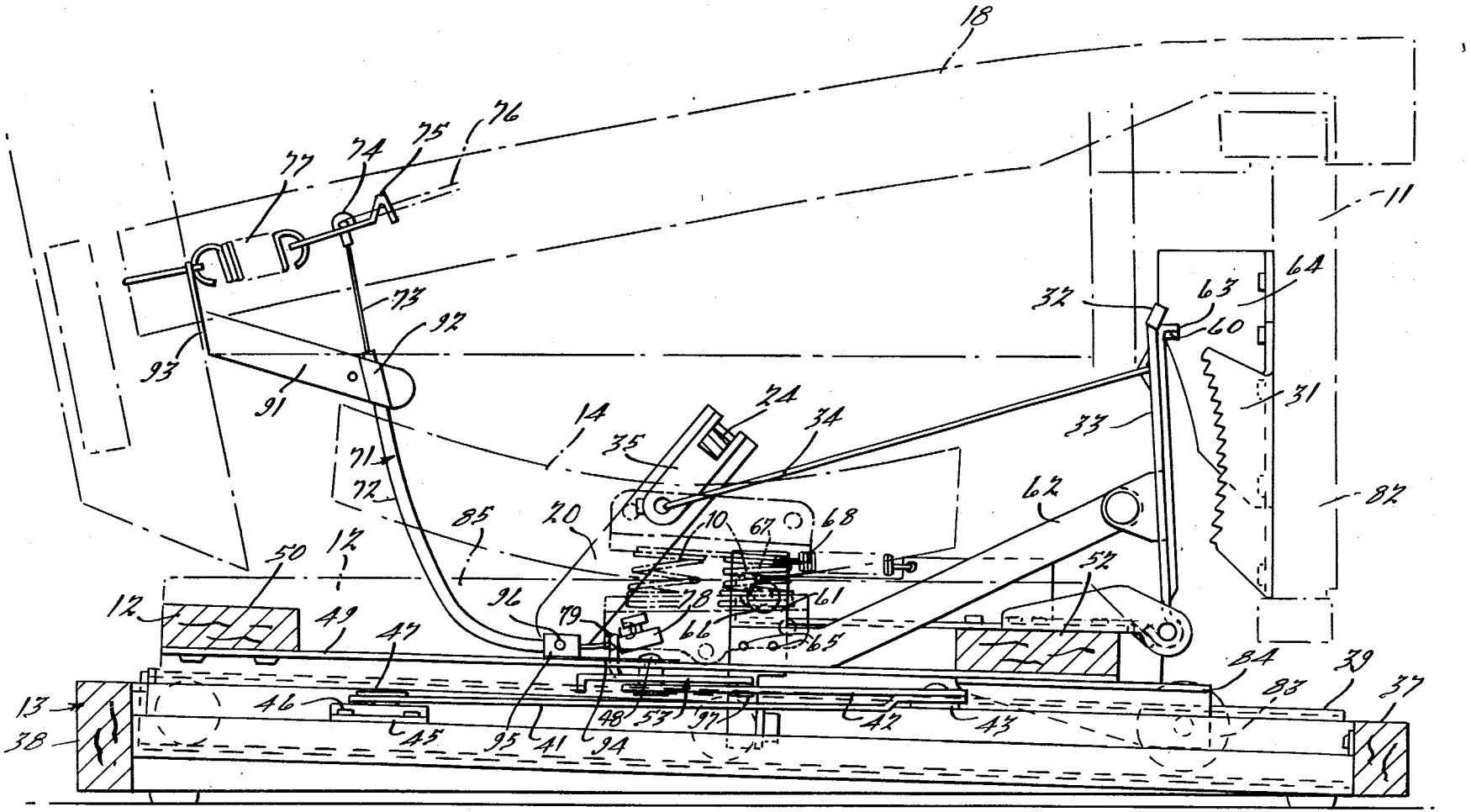
FIG. 2 is a sectional view of the chair illustrated at FIG. 1 when in rearward position with parts removed.

Referring to the drawings, a chair 11 is mounted on a sub-frame 12 which is supported on a base frame 13. The chair 11 has a pair of rocker blocks 14 which rock upon the sub-frame 12 to which it is connected by a pair of coiled springs 10 forming a rocking unit on each side of the chair. This is shown in assignee's U.S. Pat. No. 3,096,121 along with the mechanism which operates a legrest 16 which is extended by links 17 forwardly of a seat 18, as illustrated in dot and dash lines in FIG. 2. The seat 18 also moves upwardly and forwardly when the back 19 is tilted rearwardly. This relative movement between the back and the seat is obtained by the link mechanism 21 which is also shown in FIG. 2 and also in assignee's U.S. Pat. No. 3,525,549 and in FIG. 10 in the above-mentioned patent.

The side frames of the chair are interconnected at the front by a cross bar 111. The mechanism 21 is secured by a pivot 19' to a bracket 30' which is connected by a stud 20' having a spring 21' on the outer end on which a thumb nut 22' is threaded, as illustrated in FIG. 10 of the above-indicated patent. The stud passes through a slot 23' in a link 24' which is secured by a pivot 25' to the bottom end of the link 21. The thumb nut 22' may be adjusted to require a predetermined force to be applied on the back 19 in order to deflect it rearwardly and the seat 18 forwardly and upwardly. The link mechanism 21 has slidable supports 22 which are secured to opposite sides of the back 19 to permit it to be removed from the link mechanism and placed upon the seat for compact shipment.

Figures 5, 6:
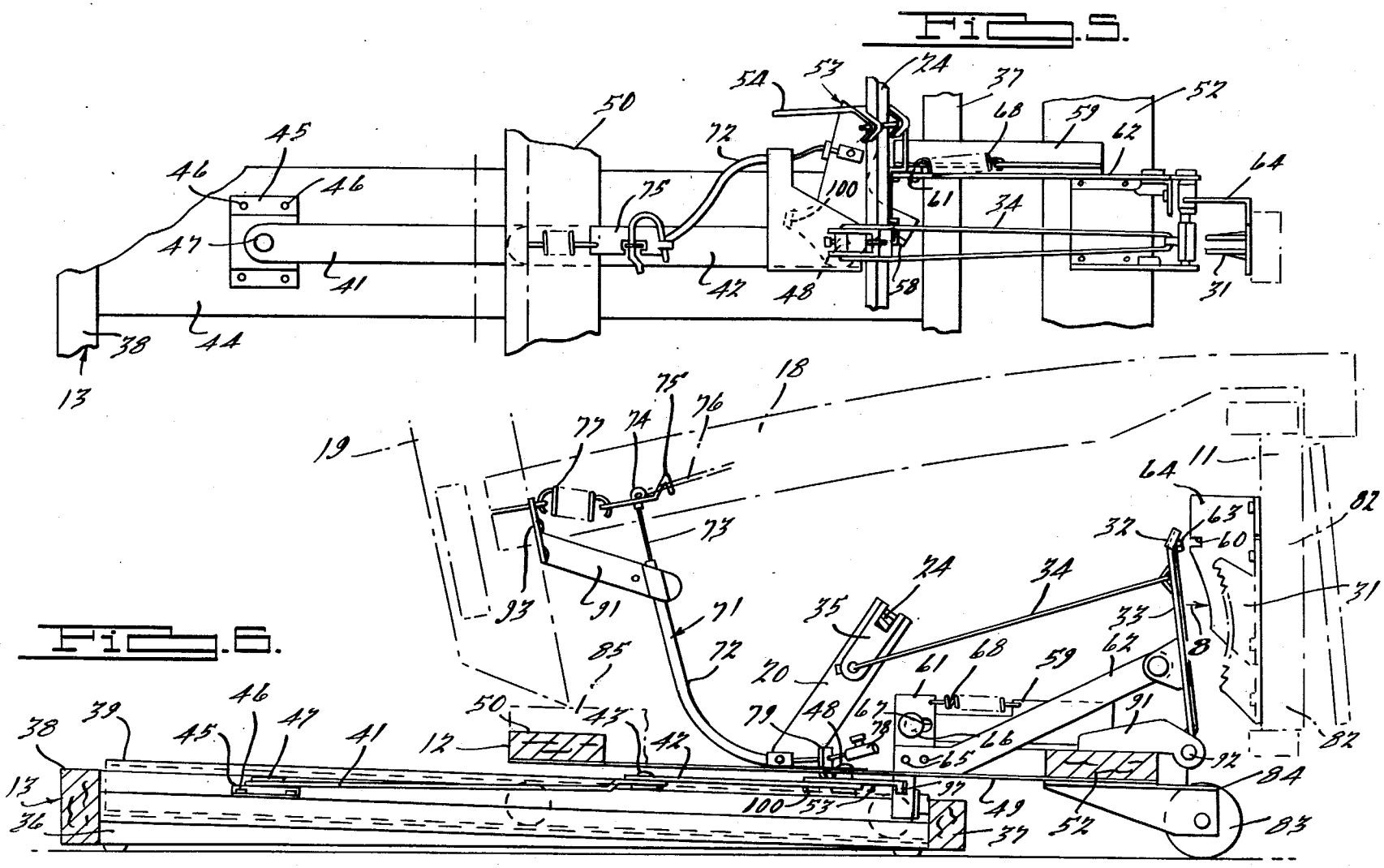
FIG. 5 is a partial view of the structure illustrated in FIG. 4 with the sub-frame latched in forward position.
FIG. 6 is a view of the structure illustrated in FIG. 2 when the chair is in forward rockable position.

A handle 23 at the righthand side of the chair operates a square shaft 24 to actuate the links 17 by a link 20 which has one end pivoted thereto and the opposite end secured to the square shaft for extending the legrest 16 to the position illustrated in FIG. 2 in dot and dash line forwardly of the front end of the chair. A plate 112 is secured to and operated by the square shaft 24 to move an arm 113 forwardly by having its forward end secured by a spring 116 to the cross bar 111, as illustrated in assignee's U.S. Pat. No. 3,325,210. The rotation of the plate 112 moves a notch 117 relative to the spring pressure detent 26 which is engaged thereby to retain the footrest 116 in a forward shortened position which is also true for the second notch 117. When the footrest 116 is advanced to full extended position, the detent 26 moves to the left in the slot portion 118 which releases the detent 26 from the notches 117 and permits the footrest 116 to be returned to retracted position, as illustrated in FIG. 2. It is to be understood that the link system 16 is at each side of the chair while the single plate 112 is disposed therebetween. The footrest mechanism is not shown in the remainder of the figures for clarity. These figures pertain to the locking of the chair in its rearward and forward positions and the unlocking of the chair in the forward position to permit the chair to rock. When the detent 26 is in the slot portion 118, the footrest may be returned to collapsed position by the reverse movement of the handle 23. When the handle 23 is moved forwardly, the detent 26 is in engagement with the cam surface 119 and will drop into a notch 117 to lock the footrest in a shorter extended position. A C-shaped link 121 is secured to the operating element 24 to apply a tension by the spring 122 when secured by a pin 123 to the rocker block 14, as illustrated in FIG. 2. The opposite end of the element 121 has a pivot 124 secured to the operating element 24 to provide a tension on the link system 17, both in extended and retracted position. Such a spring element is illustrated in the above-mentioned U.S. Pat. No. 3,325,210. The notched link 117 rotated by the shaft 24, is engaged by the detent 26 for securing the legrest 16 in different forward positions and is illustrated, described and claimed in assignee's above-mentioned U.S. Pat. No. 3,325,210. A pair of straps 27 having a reinforcing central offset 28 therein are secured by a pivot 29 to a bracket 30 at the front of the chair with the opposite end having the ends of the square shaft 24 extending therethrough for bracing the ends of the shaft which rotates therein. The front of the chair carries a toothed bracket 31 which is engaged by an end 32 of a pivoted latch 33. As illustrated in FIG. 6, the latch 33 is normally retained out of engagement with the teeth of the bracket 31 by a looped spring wire 34 secured to an arm 35 on the square shaft 24 by which it is operated. If when the legrest is extended, the chair is rocked, the end 32 of the latch 33 engages one of the teeth of the toothed bracket 31 to prevent the chair from rocking or tilting forwardly. While most of the above is old in the various assignee's patents, they are combined to produce the present chair which has additional features for locking the chair and sub-frame at their rear and forward positions on the base 13. A latched lever, to be referred to hereafter, prevents the rocking of the chair at all points except when at its forward unlatched position illustrated in FIG. 6.

The base frame 13 has side elements 36 and forwardly and rearwardly disposed cross members 37 and 38 with inwardly presenting channel elements 39 secured to the side elements 36. The channel elements 39 and the side elements 36 slope forwardly and downwardly to assist in the forward movement of the chair and sub-frame when occupied and when the locking mechanism is released. The locking mechanism embodies a long link 41 and a short link 42 which are secured together at adjoining ends by a pivot 43. The side frame elements 36 have a cross member 44 centrally disposed therebetween, as illustrated in FIG. 5, which is secured to the front and rear cross members 37 and 38. A bracket 45 is secured to the cross member 44 near the rear end thereof by screws or bolts 46. The free end of the long link 41 is secured by a pivot 47 to the bracket 45. The free end of the short link 42 is secured by a pivot 48 to a central strap 49 which is secured to a rear cross member 50 of the sub-frame and to a cross member 52 at the forward end thereof. The pivot 48 also supports an actuating element 53 which breaks the aligned relation of the links 41 and 42 when in overlapping and in extending latching positions.

Figure 4:
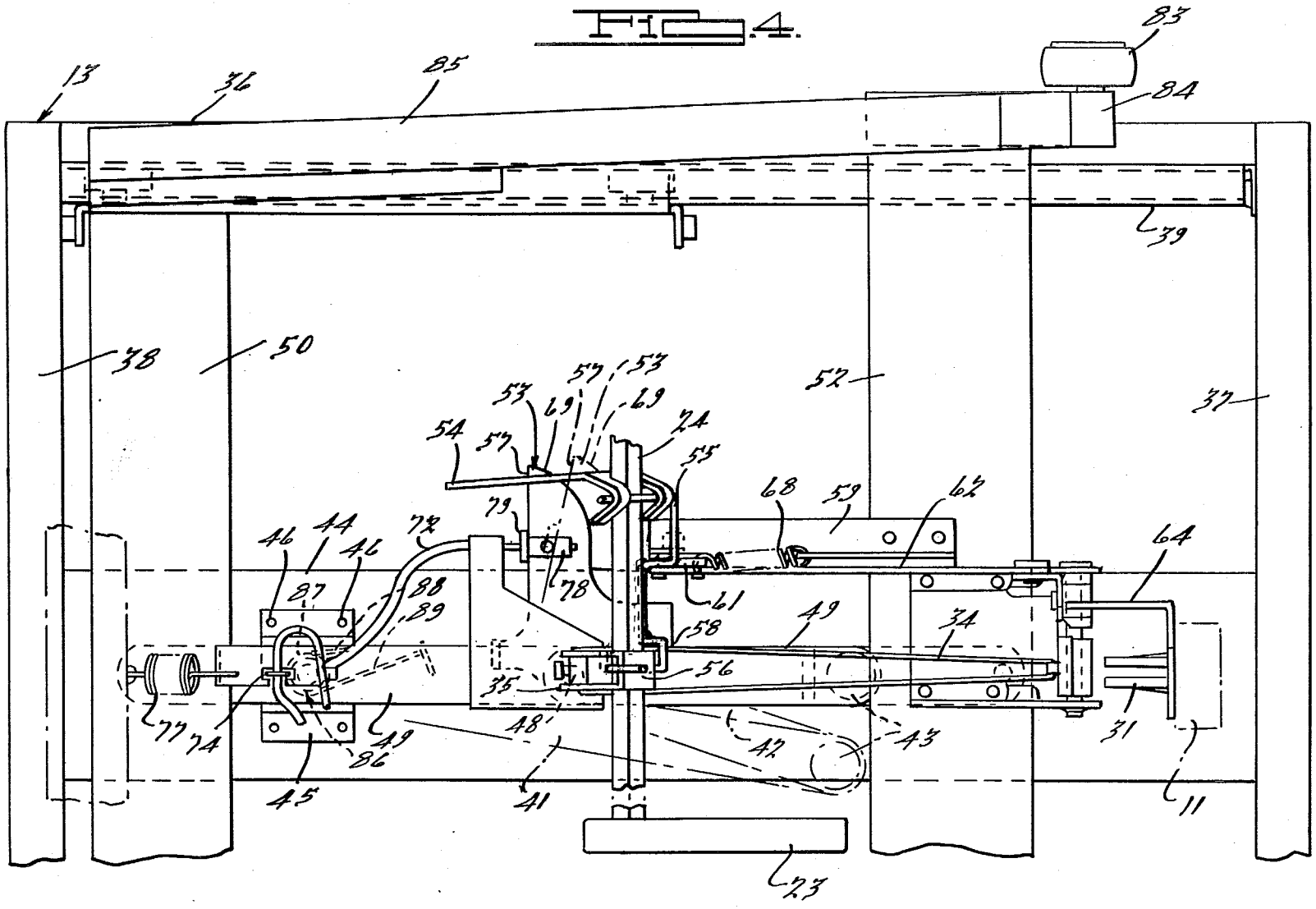
FIG. 4 is a partial plan view of the base and sub-frame with the chair removed and with the sub-frame latched in rear position.

In FIG. 4, a finger 54 is pivotally secured to the square shaft by a formed wire 55 which has one end resting on the shaft 24 when extending through the inverted V-shaped end portions which extend thereabove. The wire 55 extends along the shaft 24 with the other end disposed between the shaft 24 and the web 56 of the arm 35 and bent outwardly therefrom for locking the wire in position. The finger 54 engages an edge 57 of the actuating element 53 when the handle 23 is raised 10° or 15° to swing the element 53 about the pivot 48 to cause the extending flange 58 to move the links 41 and 42 from beneath the strap 49 to the dash line position, illustrated in FIG. 4. When the chair is occupied, the weight of the occupant will cause the sub-frame and chair to move forwardly swinging the link 42 about the pivot 43 until the links are in extension of each other beneath the strap 49. At the end of this movement a bracket 59, carried by the sub-frame, advances toward the cross member 37 until a striking plate 61 hits the cross member and holds a link 62 from moving to thereby hold a finger 63 to release its end from a slot 60 in a bracket 64 carried by the front of the chair. This permits the chair to rock in its frontmost position, the finger 63 preventing the chair from rocking either forwardly or rearwardly in all of its other positions.

The link 62 is secured to the plate 61 by a pair of rivets 65, as shown in FIG. 2. A pivot 66 which connects the plate 61 to the bracket 59 operates in a horizontal slot 67 in the bracket. A spring 68 has its end inserted in apertures in the bracket 59 and the plate 61. This provides play between the plate and the bracket sufficient to move the end of the finger 63 from the slot 60 in the bracket 64 to thereby release the chair for rocking when the chair is in its forward unlatched position. The latch 33 and the finger 63 are secured in a bracket 98 by a pivot 99 which is secured to the top of the front cross member 52. The bottom end of the latch 33 and finger 63 have rearward extending flanges 101 which abuts the forwardly extending flange 102 on the bracket 98 to limit the rearward pivoting of the latch and flanges.

After the finger 54 operates the actuating element 53 when the chair is in rear position, the pivoted links 41 and 42 are moved outwardly, as shown in FIG. 4. The finger 54 passes beyond the edge 57 of the element 53 due to the pivoted mounting of the finger 54 on the square shaft 24. When the handle 23 is operated to return the legrest 16 to the front edge 82 of the chair, as shown in FIG. 2, the finger 54 will be cammed outwardly by the arcuate surface 69 of the element 53 to be in position to engage the front edge 57 when the legrest handle 23 is again operated. When the occupant leaves the chair, a Boden unit 71 embodying a hollow coiled element 72 and a wire 73, which passes therethrough, is actuated. One end 74 of the wire is secured to a bracket 75 which connects the sinuous spring strips 76 a plurality of which forms the spring unit of the seat with a coiled spring 77 at the rear ends. When a person occupies the seat, the element 75 is deflected moving the wire 73 and an element 78 secured to the end thereof forwardly away from a flange 79 on the actuating element 53 through which the wire extends. Upon leaving the chair the deflected element 75 moves upwardly pulling the wire 73 upwardly therewith to move the element 78 against the flange 79 on the edge of the actuating element 53 which is turned counterclockwise.

The movement of the actuating element 53 counterclockwise moves the flange 100 thereon against the two links 42 which is moved with the link 41 outwardly of the strap 49 to permit the return of the chair to the wall. As an alternate to a manual return, a spring 81 between the base 13 and the sub-frame 12 pulls the sub-frame and chair to their rear positions. The top portion of the sleeve 71 of the Boden unit is supported by a pair of arms 91 having arcuate sections 92 which are secured thereabout. The arms 91 are bent outwardly at 93 and secured to the chair to move therewith. The arcuate ends 92 of the arms 91 are below the secured end of the wire 73 to have it move up and down within the coiled element 72 when the bracket 75 is raised or lowered. A plate 94 is attached to the strap 49 with the bottom end of the coiled element 72 secured in a tubular portion 95 by a screw 96. This locates the ends of the wire 73 adjacent to the sprung surface of the chair and the flange 79 of the securing element 53 which is operated counterclockwise by the element 78 secured on the bottom end of the wire.

During the return movement of the chair and sub-frame to the rear the links 41 and 42 move into overlapping position beneath the strap 49 for locking the chair in its rearmost position. Upon leaving the chair, the plate 61 is moved to its forward position by the spring 68 to thereby move the detent 63 into the slot 60 in the bracket 64 to prevent the rocking of the chair immediately upon the release of the chair from its forward position. The brackets 31 and 64 are mounted upon a vertical stationary element 82 which is fixed to the front of the chair frame. A pair of wheels 83 on angle brackets 84 projects from the front end of the side elements 85 of the sub-frame 12 to stabilize the sub-frame and chair when in the forwardmost position.

Upon occupying the chair when placed adjacent to a wall, the wire 73 is moved downwardly moving the securing element 78 at the end of the wire away from the flange 79 of the actuating element 53. The raising of the handle 23 a matter of 10° or 15° is sufficient to deflect the two links 41 and 42 outwardly from under the strap 49, as viewed in FIG. 4, to permit the weight of the occupant to move the chair and sub-frame to its forward position. In this position, the detent 63 is moved from the slot 60 in the bracket 64 to permit the rocking of the chair. The wheels 83 on the sub-frame move forwardly to engage the floor and thereby stabilize the rocking and prevent the forward tilting of the chair. Such tilting is also prevented when the handle 23 is further moved to extend the footrest whereupon the end 32 of the pivoted element 33 is advanced by the wire loop 34 and arms 35 into engagement with a tooth of the element 31.

With this arrangement, rocking can occur only when the chair the sub-frame are in forward latched position. The rocker blocks on the chair rest upon the top of the sub-frame 12 and are secured thereto by the coil springs (not shown) which are normally secured between the rocker block and the elements on which rocking occurs, as illustrated in the above mentioned copending application. The locking at the front end occurs when the two links 41 and 42 are in extension of each other directly under the strap 49 and locked in the rearmost position when the link 42 is disposed above the link 41 in aligned relation beneath the strap 49. The forward movement of the chair and sub-frame will equal twice the length of the link 42 from the center of the pivots thereof. By employing the spring 68 sufficient movement is permitted after the plate 61 strikes the face of the cross member 37 to permit the release of the detent 63 from the slot 60 in the bracket 64 so that the chair can rock in its forwardmost position.

Figure 7:
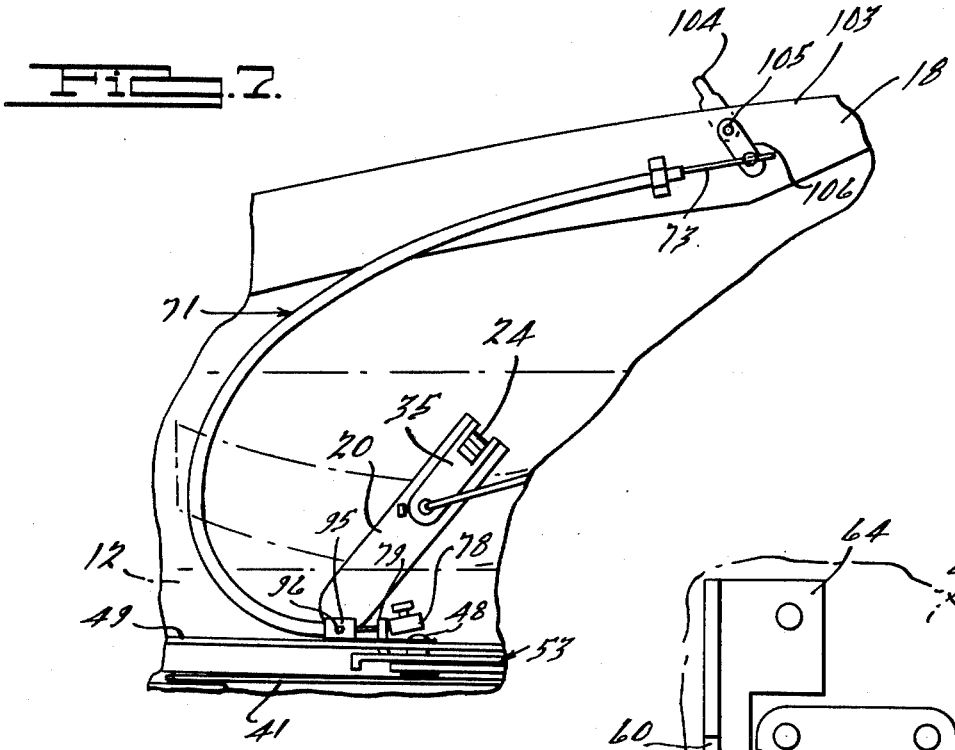
FIG. 7 is a broken view of the structure of FIG. 6 showing a lever on the seat for manually operating the Boden wire.
Figure 8:
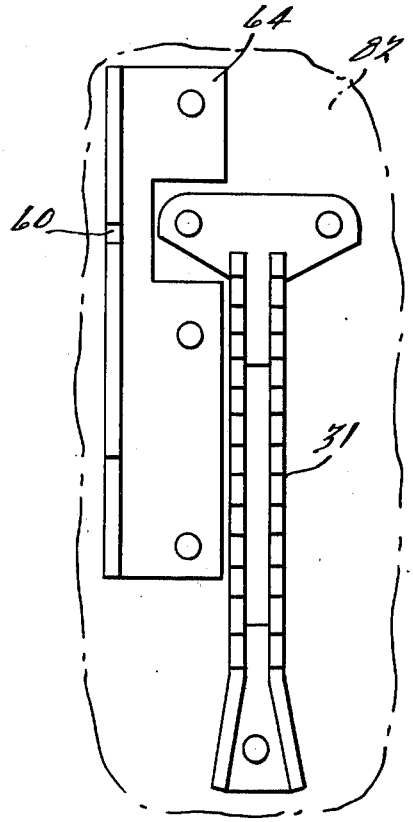
FIG. 8 is an enlarged view of the latching elements as viewed from the point of FIG. 6.
Figure 9:
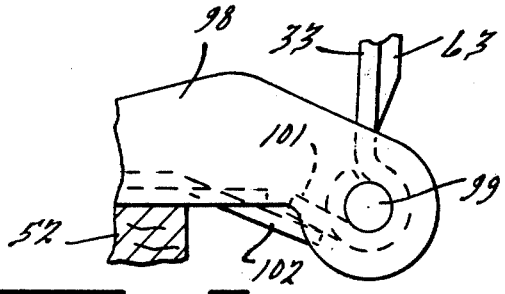
FIG. 9 is a view of the stop element adjacent to the pivot for the latch elements.

A further arrangement for releasing the chair and sub-frame from its front locked position is illustrated in FIG. 7. This Figure shows a side member 103 of the seat 18 having an operating handle 104 secured on the outer side thereof by a pivot 105 which extends through the side member 103. The inner side of the member has an operating finger 106 fixed to the inner end of the pivot 105 to which the end of the wire 73 of the Boden unit 71 is pivotedly secured. The handle 104 functions in the same manner as the plate 75 for advancing and retracting the wire 73 to permit the chair and sub-frame 12 to be released from the front locked position so it can move to the rear position. The handle 104 is preferably attached to the pivot 105 after the seat has been upholstered. There is only a slight movement required between the handle 104 and the upholstery on the chair frame when the position of the seat 18 changes relative to the frame when the back is reclned. The release of the chair when at front latched position can occur either when the occupant of the seat moves therefrom or when the handle 104 is moved rearwardly to retract the wire 73 within the element 72.

The deflection of the links 41 and 42 is assisted by a spring 86 having a central coil 87 and two arms 88 and 89, the coil 87 and arm 88 being secured within the offset central portion of the bracket 45, the arm 89 having a hooked end secured over the edge of the link 41.

What is claimed is:

1. In a wall reclining rocking chair, a sub-frame, a base for said sub-frame, a rockable chair embodying a back, seat and frame mounted on said sub-frame, means on said base sloping downwardly at the forward end on which said sub-frame is supported for forward and downward movement, a pair of links having the adjacent ends pivoted together, means for pivoting one end of one link to the base and the other end of the other link to said sub-frame in a manner to permit them to move into aligned locking relation one above and in extension of each other for locking the chair in rearward and forward positions, and means actuated when the sub-frame is locked at the forward and rearward positions for deflecting the two links out of alignment when disposed one above the other and in extension of each other for releasing said lock in both positions.

2. In a wall reclining rocking chair as recited in claim 1, wherein an actuating element is secured on the pivot attaching the link to the sub-frame for deflecting the links out of alignment when disposed one above and in extension of each other when rotated about said pivot.

3. In a wall reclining rocking chair as recited in claim 1, wherein a mechanism is provided on said chair to keep it from rocking forwardly and rearwardly except when the chair is in forward position where it is locked against forward and rearward rocking movement by the two said pivoted links when disposed in extension of each other. stopped during the final forward movement of the chair for releasing said mechanism to permit said chair to rock.

4. In a wall reclining rocking chair as recited in claim 3, wherein a stop plate is secured to a lever on said mechanism which is

5. In a wall reclining rocking chair as recited in claim 4, wherein said lever is fixed to said stop plate, a pivot on said stop plate, a bracket on said sub-frame having a horizontal slot in which said pivot is movable forwardly and rearwardly, a spring for advancing the pivot of said stop plate in said slot toward the front of the chair, and means on said base engaged by said plate near the end of the forward movement of said sub-frame to permit the bracket and mechanism to continue to move forwardly as the stop plate and link are held stationary to release the mechanism and permit the rocking of the chair when the chair and sub-frame are locked in forward position.

6. In a wall reclining rocking chair as recited in claim 1, wherein a legrest is actuated by a handle to extended position, and means operated by the initial movement of the handle to operate the actuating means and release the links from locked position when disposed one above the other to permit the weight of the chair occupant to move the chair and sub-frame to the locked front position.

7. In a wall reclining rocking chair as recited in claim 2, wherein a Boden unit has its tubular element fixed to said chair at one end and to the sub-frame at the other end with the end of the wire located adjacent to the chair secured to the sprung area of the seat and the end adjacent to said sub-frame secured to said actuating element so that when the wire moves upwardly at the time the seat becomes unoccupied the actuating element will be operated to move the links out of aligned position.

8. In a wall reclining rocking chair as recited in claim 7, wherein a plurality of sinuous springs form the sprung area of the seat, the rear end of one of said springs having the wire of the Boden unit secured thereto.

9. In a wall reclining rocking chair as recited in claim 8, wherein the wire of the Boden unit is moved downwardly when the seat is occupied to release the actuating element and is moved upwardly when the seat is unoccupied to operate the actuating element and release the lock which secures the chair in the front position.

10. In a wall reclining rocking chair as recited in claim 1, wherein a spring having a coil and two arms is so positioned as to have one arm secured relative to the base, the other arm engaging the link pivoted thereto for assisting in the deflection of the links out of alignment.

11. In a wall reclining rocking chair as recited in claim 2, wherein a Boden unit has its tubular element fixed to the seat of the chair at one end and to the sub-frame at the other end, a handle pivoted to the seat of the chair having one end of the wire of the Boden unit pivoted thereto for reciprocal movement thereby and the end adjacent to said sub-frame secured to said actuating element so that when the wire is moved upwardly the actuating element will be operated to move the links out of aligned position.

* * * * *

UNITED STATES PATENT AND TRADEMARK OFFICE

CERTIFICATE OF CORRECTION

PATENT NO. : 4,179,157

DATED : December 18, 1979

INVENTOR(S) : Edwin J. Shoemaker, William (nmi) Pacitti, Marvin J. Baumann

It is certified that error appears in the above—identified patent and that said Letters Patent is hereby corrected as shown below:

Column 5, Line 14, "the" (second occurrence) should be --and--

Column 5, Line 49, "reclned" should be --reclined--

Column 6, Claim 3, Line 19, after "." delete --stopped during the final forward movement of the chair for releasing said mechanism to permit said chair to rock--

Column 6, Claim 4, Line 24, following "is" insert -- stopped during the final forward movement of the chair for releasing said mechanism to permit said chair to rock--.

Signed and Sealed this

*Twentieth* Day of *April 1982*

[SEAL]

*Attest:*

GERALD J. MOSSINGHOFF

*Attesting Officer*

*Commissioner of Patents and Trademarks*